US006239343B1

(12) United States Patent
Hoshino

(10) Patent No.: US 6,239,343 B1
(45) Date of Patent: May 29, 2001

(54) CYMBAL HOLDER WITH VIBRATION DAMPING

(75) Inventor: Yoshihiro Hoshino, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 09/543,128

(22) Filed: Apr. 5, 2000

(30) Foreign Application Priority Data

Nov. 3, 1999 (JP) ..... 11-009104

(51) Int. Cl.[7] ..... G10D 13/02
(52) U.S. Cl. ..... 84/422.3; 84/422.1; 84/422.2
(58) Field of Search ..... 84/422.1, 422.2, 84/422.3

(56) References Cited

U.S. PATENT DOCUMENTS 4,216,695 8/1980 Hoshino .
5,388,495 * 2/1995 Atsumi ..... 84/422.3
5,936,174 * 8/1999 Liao ..... 84/402
6,011,209 * 1/2000 Liao ..... 84/422.3

* cited by examiner

*Primary Examiner*—Robert E. Nappi
*Assistant Examiner*—Kim Lockett
(74) *Attorney, Agent, or Firm*—Ostrolenk, Faber, Gerb & Soffen, LLP

(57) ABSTRACT

A cymbal holder including: a support member having an installation hole; a holding rod installed in the hole, the rod having a tool holding lower region above the installation hole and having a screw threaded upper region; a tubular, cymbal receiving tool with a tubular part disposed around the holding rod and having a radially projecting receiving part intermediate its length; a cymbal on the tubular part of the tool; a lower elastic member between the receiving part on the tubular part of the tool and the cymbal; an upper elastic member above the cymbal and held by a nut tightened on the screw thread of the rod; the cymbal receiving part is intermediate the length of the tubular part of the cymbal receiving tool so that the cymbal receiving tool is adapted to be installed with either of its side portions above the receiving part being up or down, so that the tool can be inverted as required.

11 Claims, 9 Drawing Sheets

FIG. 3
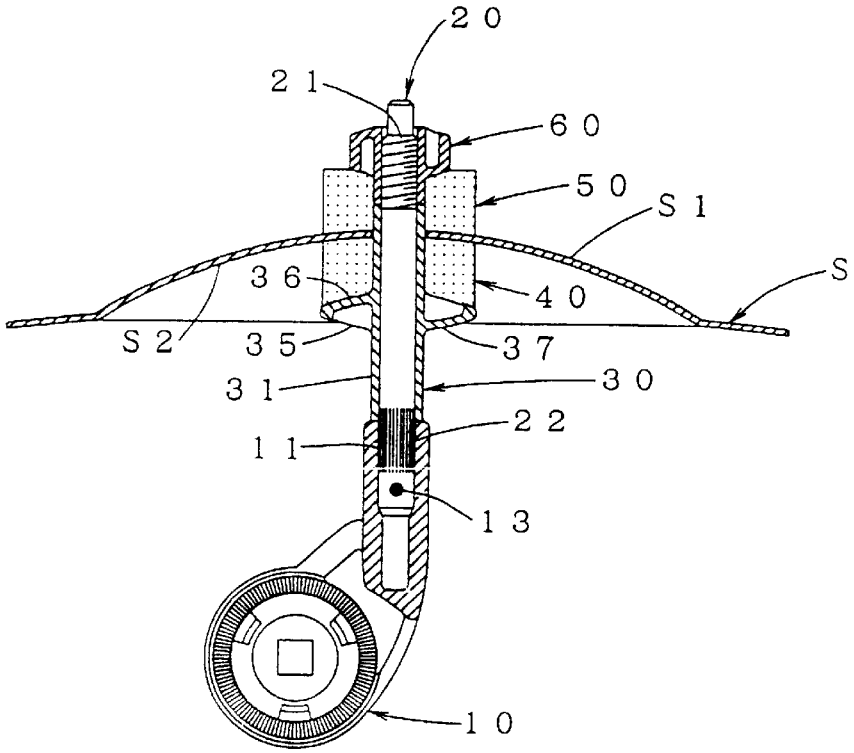
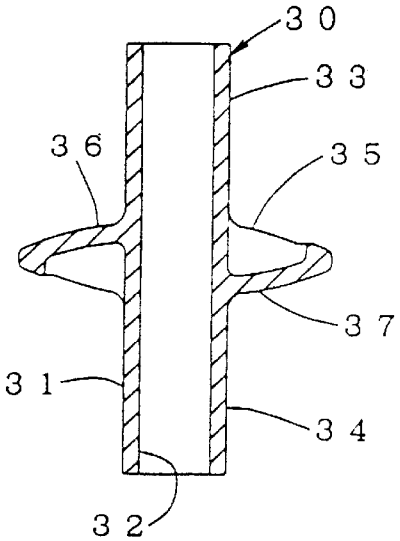
FIG. 4a
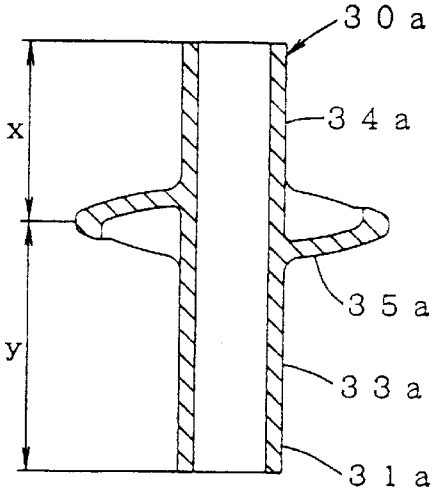
FIG. 4b

CYMBAL HOLDER WITH VIBRATION DAMPING

BACKGROUND OF THE INVENTION

This invention relates to the structure of a cymbal holder and more particularly to adjustable clamping and vibration damping of the cymbal.

DESCRIPTION OF A PRIOR ART EMBODIMENT

FIGS. 8–10 show a cymbal S installed on a cymbal stand ST through a support member or angle adjustment member 10 that can be fixed at a suitable tilt angle with respect to a fixed support rod R of the cymbal stand ST to enable the installation angle of the cymbal S to be freely adjusted.

A holder part for the cymbal S includes a roulette or longitudinally ribbed spline 72 at the bottom of the holding rod 70 which is inserted into an installation hole 11 of the support member 10. A cymbal receiver 75 extends through a central hole H through the cymbal S. A receiving part 78 at the bottom of the receiver 75 seats on the step 74 formed on the holding rod 70.

A lower elastic member 80 rests on the receiving surface 79 of the receiving part 78 of the tool 75. The lower elastic member 80 has a hole 81 through it. The lower surface S2 of the cymbal S is placed on the upper surface of the lower elastic member 80.

An upper elastic member 85 is placed at the upper surface S1 of the cymbal. The upper elastic member 85 has a hole 86 through it.

A nut 90 is screwed onto the screw thread 71 at the upper region of the holding rod 70 from above the upper elastic member 85, as shown in FIGS. 9 and 10. It holds the elements 70–90 together.

The cymbal receiver 75 has a tubular part 76, which surrounds and defines an inner hole 77. The tubular part only extends up from the receiving part 78. If the cymbal receiver 75 were made of a hard metal, it would scrape or carve the periphery of the hole H in on the cymbal and thereby enlarge the central hole H through the cymbal S. Therefore, the receiver is preferably made of a resin. Nevertheless, it is inevitable that the tubular part 76 of the cymbal receiver 75 will rub against and wear the periphery of the central hole H of the cymbal S due to the vibrations of the cymbal S during a performance. If wearing of the tubular part 76 of the cymbal receiver 75 becomes extreme, the central hole H of the cymbal S and the holding rod 70 will eventually contact each other. Replacement of the cymbal receiver 75 is necessary when its wearing reaches a certain extent. However, frequent and repeated replacement of the cymbal receiver 75 has been troublesome and undesirable in terms of manufacturing cost and user convenience.

SUMMARY OF THE INVENTION

The invention provides a cymbal holder which is advantageous in terms of the cost and operation and which is capable of reducing the frequency of replacement of the cymbal receiver.

The cymbal holder comprises several elements. There is a support member having a rod receiving installation holder. A holding rod has a screw thread at the region toward its top end and has a roulette or ribbed spline its bottom end region. The roulette is inserted in and is partly exposed above the installation holder of the support member. A cymbal receiver has a tubular body that is passed from below through a central hole through the cymbal. The holding rod is inserted through the inner hole through the tubular body, until the bottom end region of the rod with the exposed roulette part thereon receives and holds the bottom of the cymbal receiver on the roulette part.

A receiving part protrudes radially outward, extends in the circumferential direction around and is disposed intermediate the length of the tubular part in the tubular or longitudinal direction. The receiving part of the cymbal receiver tool is positioned along the tubular part either midway along the tubular part or where one side portion of the tubular part is long and the other side portion of the tubular part is short along the tubular part. Both opposite top and bottom surfaces of the receiving part constitute receiving surfaces.

A lower elastic member has a hole for insertion of the tubular part of the cymbal receiving tool, and the elastic member is positioned between the upwardly facing surface of the receiving part and the lower surface of the cymbal. An upper elastic member positioned on the upper surface of the cymbal has a hole through it for insertion of the tubular part of the cymbal receiving tool. A tightening nut is screwed to the screw threaded top end region of the holding rod from above the upper elastic member.

Other objects and features of the invention are explained below by referring to the attached drawings.

BRIEF DESCRIPTION OF THE DRAWINGS

FIG. 3 is a cross section showing the assembled state.

FIGS. 4*a* and 4*b* are cross sections showing two examples of a cymbal receiving tool.

DESCRIPTION OF PREFERRED EMBODIMENTS

Figure 1:
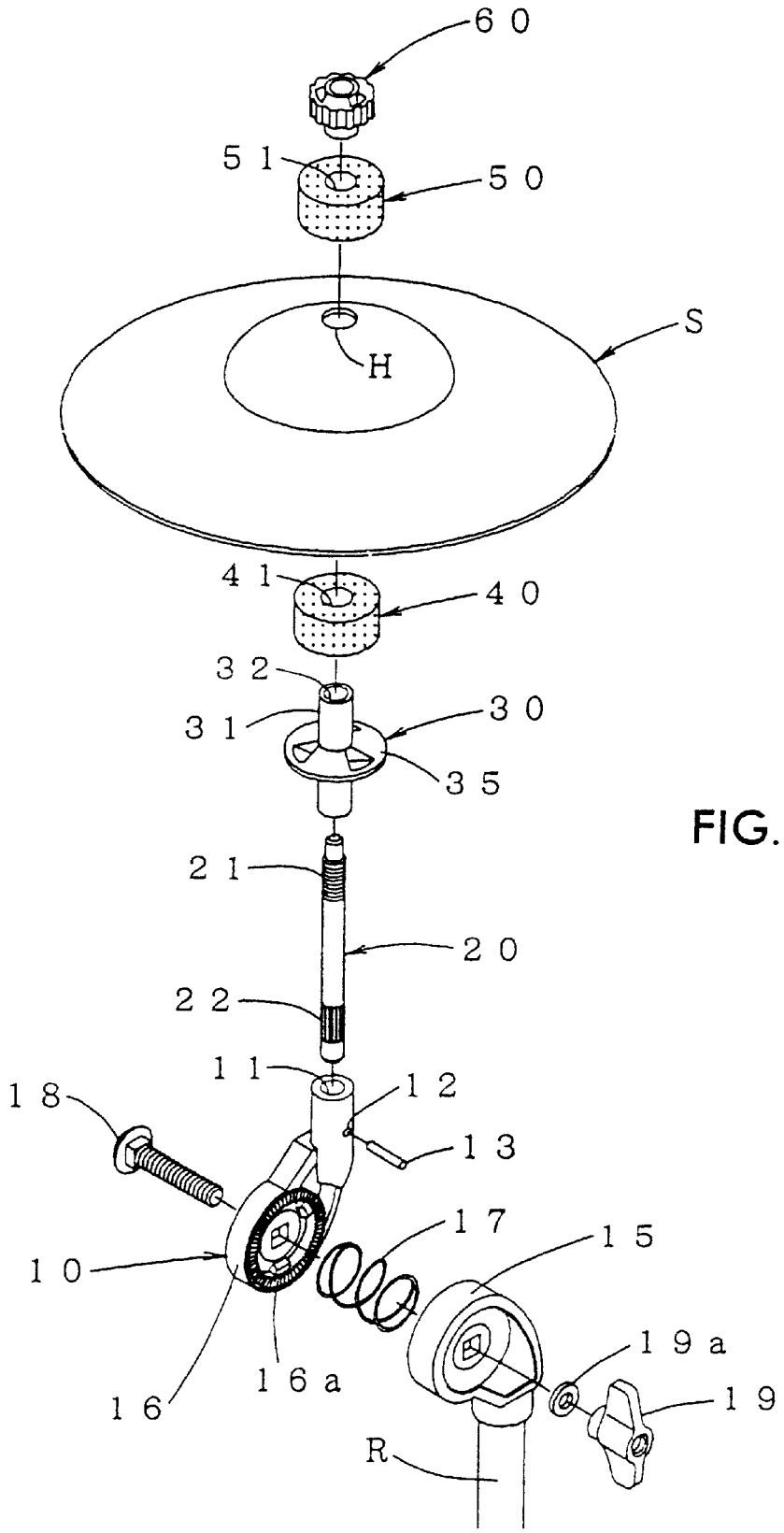
FIG. 1 is an oblique view of a cymbal holding part according to the invention.
Figure 2:
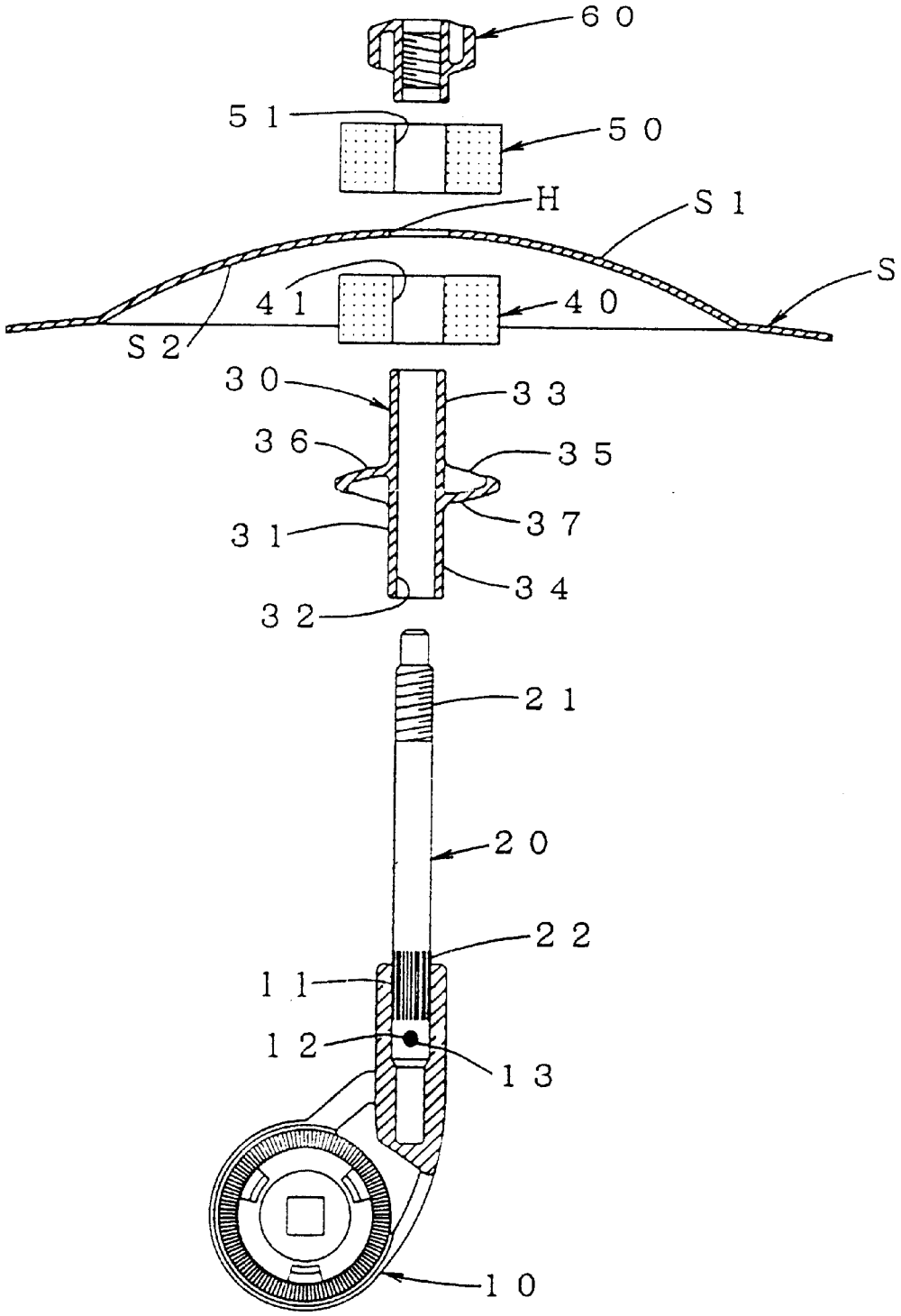
FIG. 2 is an exploded elevational cross section.
Figure 8:
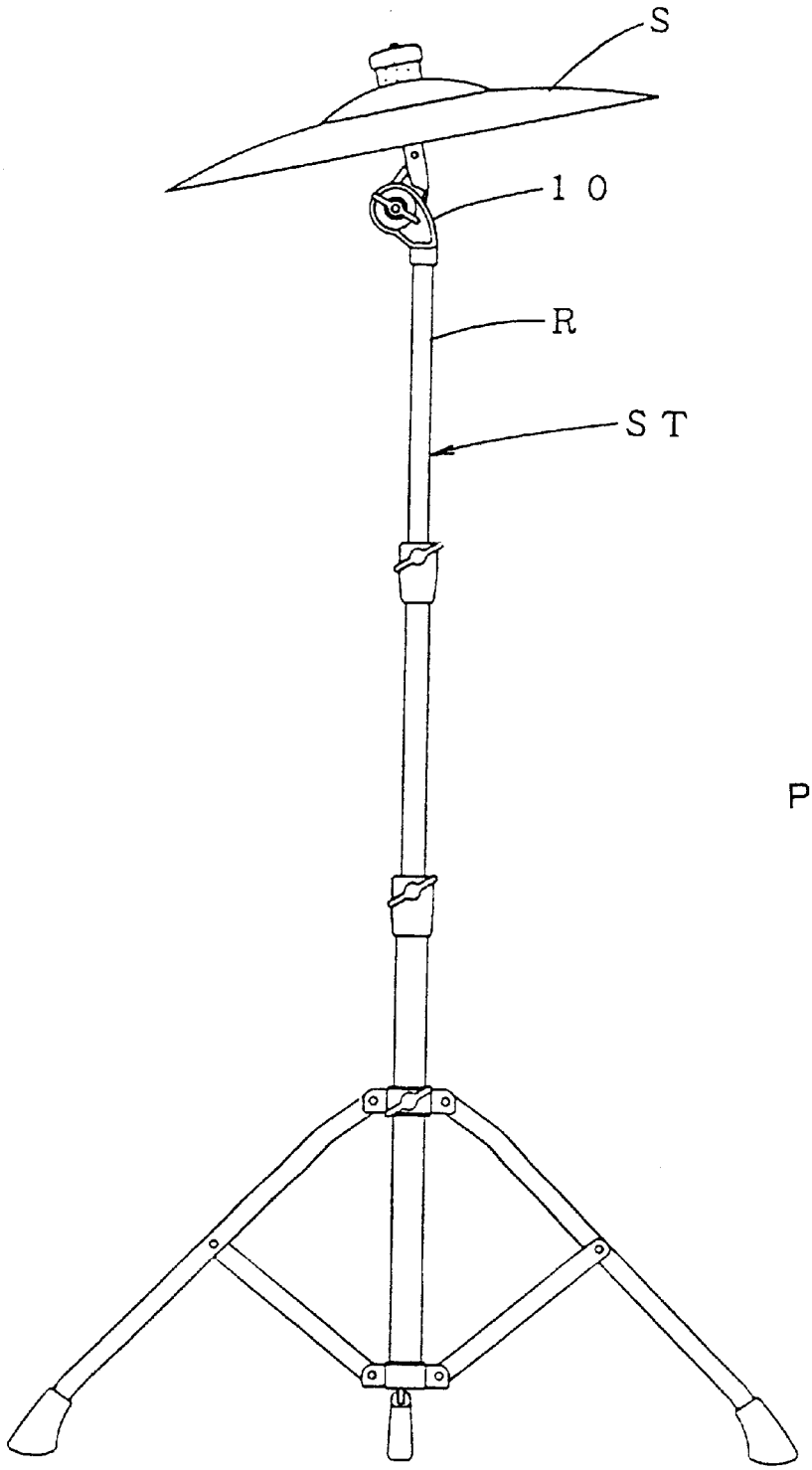
FIG. 8 PRIOR ART
FIG. 8 shows a cymbal and cymbal stand combination of the prior art.
Figure 9:
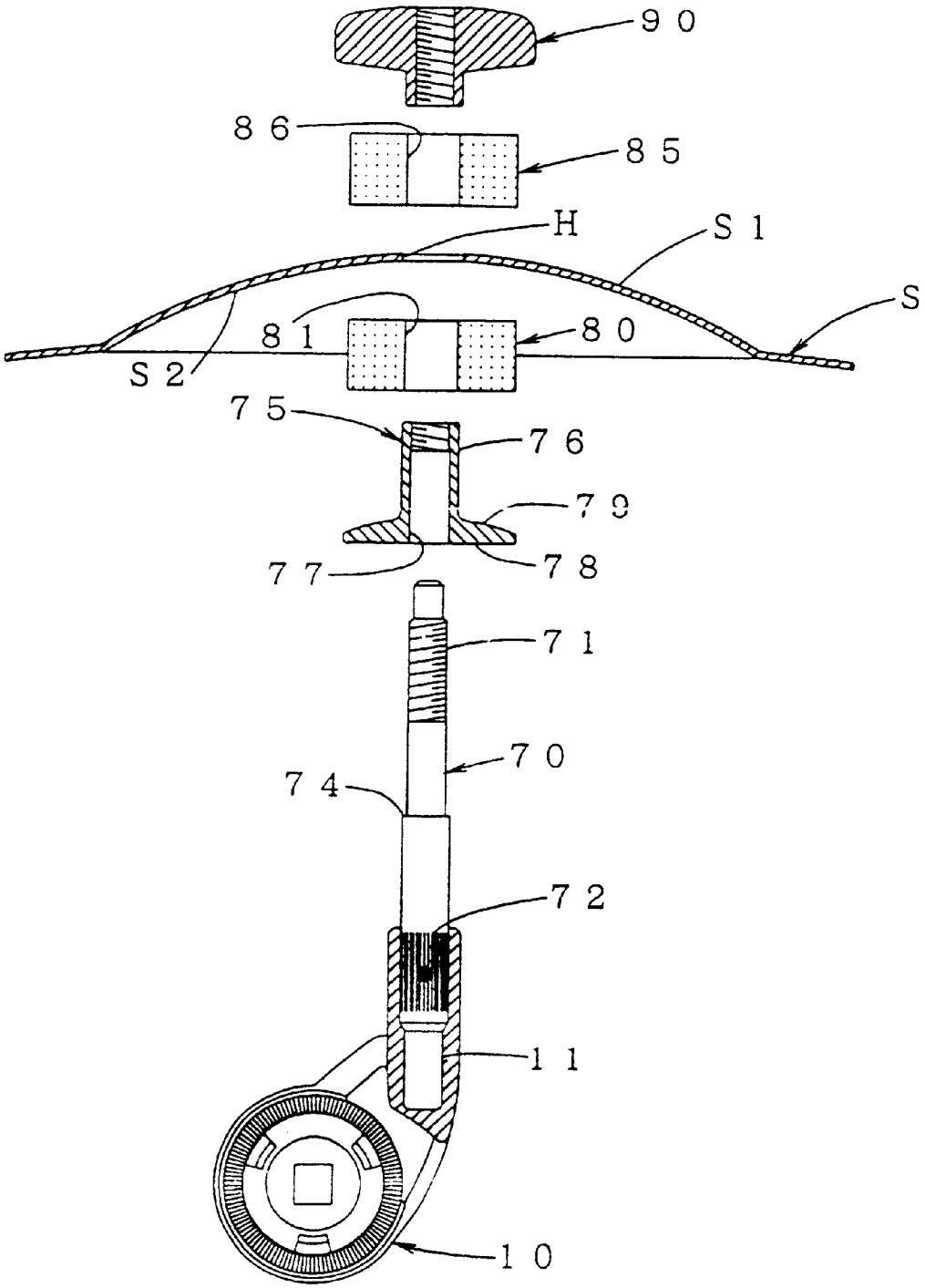
FIG. 9 PRIOR ART
FIG. 9 is an exploded cross section of the cymbal holding part according to the prior art.
Figure 10:
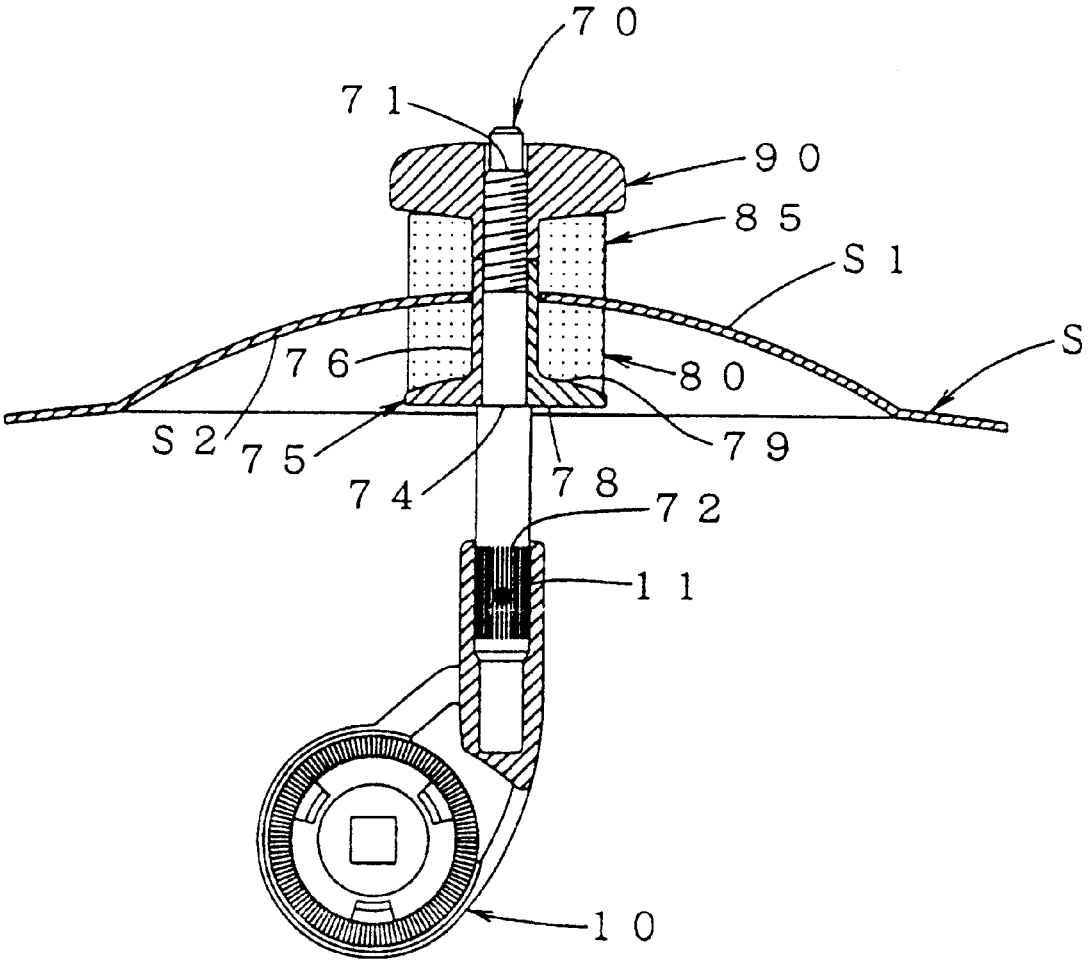
FIG. 10 PRIOR ART
FIG. 10 is a cross section showing the assembled state of the assembly shown in FIG. 9.

FIGS. 1 and 2 show a dismantled state and FIG. 2 shows an assembled state of the cymbal holder of the invention. The cymbal holder comprises a support member 10 or angle adjustment member to be positioned on a fixed rod R of the cymbal stand ST. That stand has a structure similar to the conventional structure described above and shown in FIG. 8. The cymbal holder includes a holding rod 20, a cymbal receiving tool 30 on the rod, a lower elastic member 40 below the cymbal, an upper elastic member 50 above the cymbal and a tightening nut 60 above the upper elastic member.

Next to the support member 10 there is a fixed member 15 which is above and slightly to the side of the fixed rod R. A movable member 16 in the support member 10 faces toward and engages the opposed, not shown face of the fixed member 15. There is a coil spring 17 between the members 15 and 16. A bolt 18 passes through the members 15 and 16 and then receives an adjusting nut 19, beneath which is a washer 19*a*. Tightening of the nut 19 draws the members 15 and 16 together. There is a gearing surface (not seen in the drawing) formed on the opposed side of the fixed member 15 that is complementary to the toothed surface 16*a* of the movable member 16. These elements combine to maintain a prescribed rotary angle of the movable member 16 and the tilt angle of the cymbal 5.

The support member 10 has an upstanding tubular part with an installation hole 11 for receiving an inserted holding rod 20. The installation hole 11 has such diameter and depth as to prevent shakiness of the inserted holding rod 20. The side wall of the tubular part 11 has a small radial hole 12 for receiving a spring pin 13 for firmly fixing the holding rod 20 inserted into the installation hole 11.

The holding rod 20 in the installation hole 11 of the support member 10 receives the cymbal receiving tool 30 around the rod, the lower elastic member 40 above the tool 30, the cymbal S above that and the upper elastic member 50 above the cymbal. The holding rod 20 has a screw thread 21 at the region toward its top end which receives the tightening nut 60 which is applied from above the upper elastic member 50.

Toward its bottom end, the rod 20 has a ribbed spline or roulette 22 which is inserted into the installation hole 11 of the support member 10. The spline 22 has such length that part of it may be exposed above the member 10 when the rod has been inserted into the installation hole 11. The length of the exposed part of the spline is such that the then depending portion 33 or 34 of the tubular part 31 of the cymbal receiving tool 30 is firmly fixed in place at the time it is compressively installed onto the spline 22, without those parts being separated when the cymbal S is installed or dismantled, but that such insertion enables those parts to be separated when they are pulled firmly by hand.

The cymbal receiving tool 30 is comprised of a non-metallic material like a resin, etc. It has a two portion tubular part 31 and has a wide receiving part 35 partially along the length of the tubular part. The tubular part 31 is inserted from below through a hole 41 through the lower elastic member 40, the central hole H through the cymbal S and a hole 51 through the upper elastic member 50.

The holding rod 20 is compressively inserted into and fixed in the inner hole 32 of the tubular part 31 of the tool 30, with the part of the spline 22 that is exposed above the installation hole 11 receiving the tubular part 31 on the cymbal receiving tool 30 when those elements are assembled.

At an intermediate position, e.g. about half way along the length of the tubular part 31, the radially outwardly protuberant receiving part 35 extends circumferentially around the outside of the part 31 and is of a circular shape, as viewed from above. Both of the opposite top and bottom surfaces of the receiving part 35 comprise receiving surfaces 36 and 37. As a result, when the cymbal S is held with the receiving surface 36 of the part 35 facing up, the then upwardly extending portion 33 of the tubular part 31 extends through and through use of the cymbal is caused to rub against the periphery of the hole H of the cymbal S, eventually resulting in wear. At that time, the tubular part 31 may be inverted so that the receiving surface 37 faces upward, and the other portion 34 of the tubular part, which has not been worn, extends up through and contacts the periphery of the central hole H of the cymbal S.

The lower elastic member 40 protects and also secures the cymbal S as the member 40 is mounted between the receiving part 35 of the cymbal receiving tool 30 and the lower surface S2 of the cymbal. The member 40 is made of a soft material, such as sponge or synthetic resin foam, etc. The lower elastic member 40 has a hole 41 through which the tubular part 31 of the cymbal receiving tool 30 is inserted.

The tightening nut 60 is screwed on the screw thread 21 just below the top end of the holding rod 20, and the nut presses on the top of the upper elastic member 50. As the roulette part 22 at the bottom of the holding rod 20 is inserted into the installation hole 11 of the support member 10 and the spring pin 13 is inserted, the holding rod 20 is fixed to the support member 10. As the cymbal receiving tool 30 receives the holding rod 20 compressively, the tool 30 is fixed. As the lower elastic member 40, the cymbal S and the upper elastic member 50 are installed on the tubular part 31 of the cymbal receiving tool 30, and then tightening nut 60 is screwed on to the holding rod 20, the cymbal S is sandwiched and is held by the cymbal receiving tool 30, the lower elastic member 40, the upper elastic member 50 and the tightening nut 60.

In FIGS. 2 and 3, the receiving part 35 of the cymbal receiving tool 30 is formed at an intermediate, and particularly a central, position along the tubular direction of the tubular part 31, as shown in FIG. 4(*a*). However, the receiving part 35*a* of the cymbal receiving tool 30*a* may be formed at a position along the tubular part 31*a* where one side or portion 33*a* in the tubular direction is longer, while the other side or portion 34*a* is shorter, as shown in FIG. 4(*b*).

Figure 5:
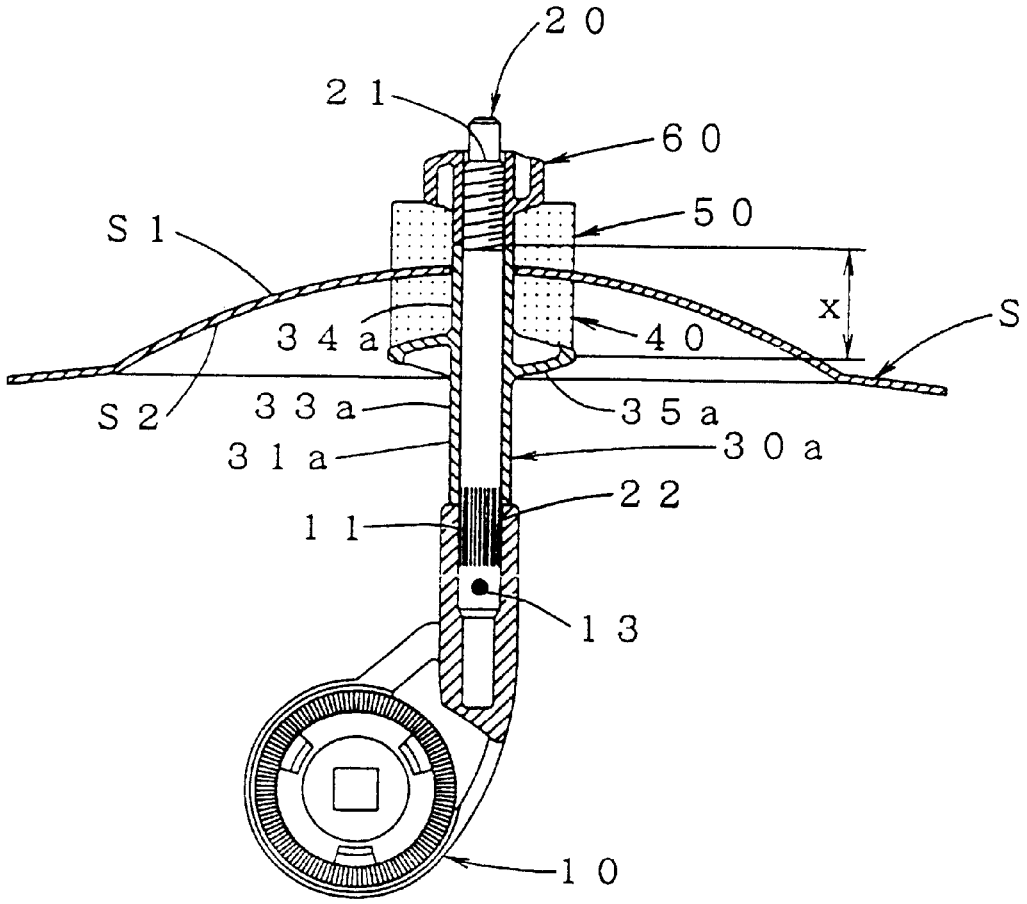
FIG. 5 is a cross section showing an installation with the cymbal receiving tool of FIG. 4(*b*).

If the cymbal receiving tool 30*a* is assembled with the shorter side portion 34*a* of the tubular part 31*a* facing up, the distance x between the receiving part 35*a* of the cymbal receiving tool 30*a* and the tightening nut 60 is shortened, as shown in FIG. 5, causing the cymbal S to be held more tightly.

Figure 6:
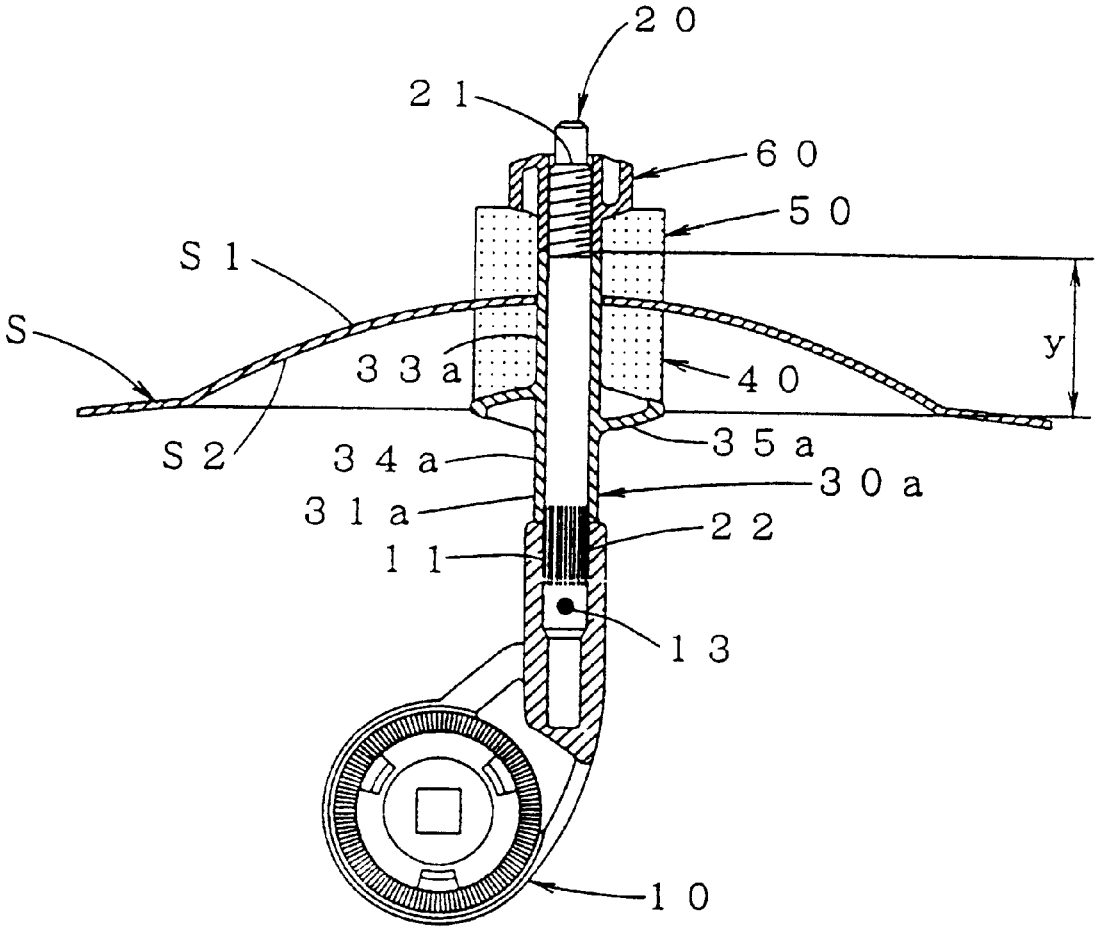
FIG. 6 is a cross section showing another installation with the cymbal receiving tool of FIG. 4(*b*).

On the other hand, if the cymbal receiving tool 30*a* is assembled with the longer side portion 33*a* of the tubular part 31*a* facing up, as shown in FIG. 6, the distance y between the receiving part 35*a* of the cymbal receiving tool 30*a* and the tightening nut 60 is increased, causing the cymbal S to be held loosely.

Varying the distance between the receiving part 35*a* of the cymbal receiving tool 30*a* and the tightening nut 60 makes it possible to hold the cymbal S loosely, as shown in FIG. 6, when the cymbal S is held horizontally and to hold the cymbal tightly, as shown in FIG. 5, so that the cymbal may not become horizontal when the cymbal should be held inclined.

Figure 7:
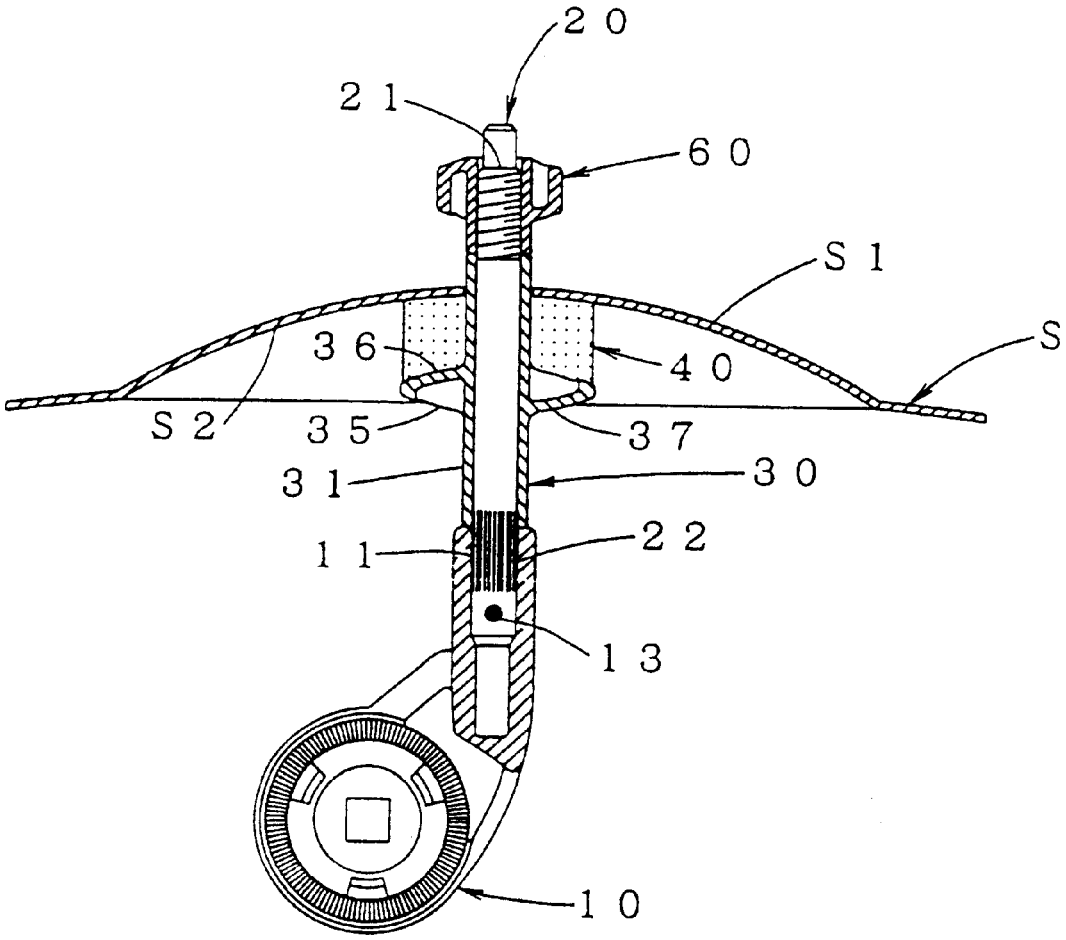
FIG. 7 is a cross section showing an example of the assembly without an upper elastic member.

When the cymbal S is held horizontally, it is possible to not mount the upper elastic member 50, as shown in FIG. 7. This makes it difficult to mute the sound of the cymbal S, so that its sound may be prolonged. In such a case, if the tightening nut 60 is made of resin, no unnecessary sound would be produced even if the cymbal S may strike the tightening nut 60.

The structure of the cymbal holding part, as has been explained above, has both sides 36, 37 of the receiving part 35 of the cymbal receiving tool 30 as receiving surfaces. Even if one side or portion 33, 34 of the tubular part 31 may become worn out, the tubular part 31 can be inverted, thereby making it possible to prolong the life of the cymbal receiving tool. It would be advantageous for the cost and operation if the number of replacements of the cymbal receiving tool can be reduced.

When the receiving part of the cymbal receiving tool is formed at a position where one side portion of its tubular part is longer, while the other side portion is shorter, the up and down facing side portions of the tubular part can be reversed, thereby changing the state of the holding of the cymbal, either tightly or loosely and the holding may be looser when the cymbal is held horizontally and tighter when the cymbal is held inclined.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed:

1. A cymbal holder comprising:

a support member including an installation hole;

a holding rod having a top region with a screw threaded part thereon and having a lower end region, the lower end region being installed in the installation hole;

a cymbal receiving tool having a tubular part with an opening through the tubular part extending the length of the tool, the tubular part of the cymbal receiving tool extending through a central hole of a cymbal; the holding rod being inserted through the opening through the tubular part of the tool, the tool having a lower end which is pressed onto the lower region of the holding rod;

a receiving part which protrudes radially from the tubular part of the tool, the receiving part being located partway along the length of the tool, the receiving part having opposite first and second surfaces facing along the tubular part, a first side portion of the tubular part being above the first surface of the receiving part and a second side portion of the tubular part being below the second surface of the receiving part, and both of the first and second surfaces of the receiving part are receiving surfaces;

a lower elastic member having a hole through which the then upwardly extending first portion of the tubular part of the tool passes and the first portion of the tool then passes through the central hole of the cymbal, and the lower elastic member having one side against the cymbal and an opposite side against the first surface of the receiving part;

a tightening nut above the cymbal and screwed on the threaded part of the holding rod for holding the cymbal at least against the lower elastic member and for holding the lower elastic member on the receiving part of the cymbal receiving tool.

2. The cymbal holder of claim 1, further comprising an upper elastic member disposed between the cymbal and the tightening nut, the upper elastic member having a hole in it for receiving the first side portion of the tubular part of the cymbal receiving tool which has been passed through the central hole of the cymbal, and the nut on the screw threaded part of the rod tightening the upper elastic member against the cymbal.

3. The cymbal holder of claim 2, wherein the lower region of the holding rod has a roulette part that is so placed along and is of such length along the rod that the roulette part is inserted in the installation hole in the support member and the roulette part has a portion extending above the installation hole, and the cymbal receiving tool second side portion has the opening therein so shaped that it may be pressed onto the roulette part of the rod for holding the cymbal receiving tool to the rod and thereby to the support member.

4. The cymbal holder of claim 1, wherein the lower region of the holding rod has a roulette part that is so placed along and is of such length along the rod that the roulette part is inserted in the installation hole in the support member and the roulette part has a portion extending above the installation hole, and the cymbal receiving tool second side portion has the opening therein so shaped that it may be pressed onto the roulette part of the rod for holding the cymbal receiving tool to the rod and thereby to the support member.

5. The cymbal holder of claim 4, wherein the roulette part comprises a ribbed spline extending along the holding rod.

6. The cymbal holder of claim 1, further comprising a main support for the cymbal holder;

a connection between the main support and the support member, and the connection being adapted to permit the support member to be tilted to various selected tilt orientations, thereby enabling tilting of the cymbal to a selected orientation with respect to the horizontal.

7. The cymbal holder of claim 1, further comprising a securement device at the support member for securing the holding rod in the installation hole of the support member.

8. The cymbal holder of claim 7, wherein the securement device comprises a pin projecting through the support member and pressing against the holding rod for holding the rod in the support member installation hole.

9. The cymbal holder of claim 1, wherein the receiving part of the cymbal receiving tool is positioned along the tool substantially at the middle of the length of tool in the tubular direction, whereby the first and second portions of the tubular part of the tool are essentially the same length.

10. The cymbal holder of claim 1, wherein the cymbal receiving tool is positioned along the length of the tubular part of the cymbal holding tube wherein the first portion of the tubular part is longer and the second portion of the tubular part is shorter.

11. The cymbal holder of claim 1, wherein the first and second portions of the tubular part are respectively so shaped and the receiving part thereof is respectively so shaped that the tubular part and the receiving part thereof may be selectively inverted so that either of the first and second side portions of the tubular part extends up through the cymbal or extends down into the installation hole of the support member.

* * * * *